US011295886B2

(12) United States Patent
Mai et al.

(10) Patent No.: US 11,295,886 B2
(45) Date of Patent: Apr. 5, 2022

(54) WINDING ARRANGEMENT HAVING A PLUG-IN BUSHING

(71) Applicant: SIEMENS AKTIENGESELLSCHAFT, Munich (DE)

(72) Inventors: Tim-Felix Mai, Wendlingen (DE); Richard Sille, Kirchheim (DE); Steffen Weinert, Wangen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 374 days.

(21) Appl. No.: 16/080,034

(22) PCT Filed: Feb. 9, 2017

(86) PCT No.: PCT/EP2017/052839
§ 371 (c)(1),
(2) Date: Aug. 27, 2018

(87) PCT Pub. No.: WO2017/153115
PCT Pub. Date: Sep. 14, 2017

(65) Prior Publication Data

US 2019/0066898 A1 Feb. 28, 2019

(30) Foreign Application Priority Data

Mar. 8, 2016 (DE) ..... 10 2016 203 776.5

(51) Int. Cl.
*H01B 17/26* (2006.01)
*H01F 27/04* (2006.01)
(Continued)

(52) U.S. Cl.
CPC ..... *H01F 27/04* (2013.01); *H01F 27/022* (2013.01); *H01F 27/30* (2013.01); *H01F 27/32* (2013.01); *H01F 41/10* (2013.01); *H01F 41/125* (2013.01)

(58) Field of Classification Search
CPC ..... H01F 27/04; H01F 27/022; H01F 27/30; H01F 27/32; H01F 41/10; H01F 41/125
(Continued)

(56) References Cited

U.S. PATENT DOCUMENTS 3,368,175 A 2/1968 Giegerich et al.
4,205,290 A * 5/1980 Canney ..... H01F 27/022 336/90
(Continued)

FOREIGN PATENT DOCUMENTS

CN 1155742 A 7/1997
CN 101336460 A 12/2008
(Continued)

*Primary Examiner* — Andargie M Aychillhum
(74) *Attorney, Agent, or Firm* — Laurence A. Greenberg; Werner H. Stemer; Ralph E. Locher

(57) ABSTRACT

A winding configuration for a transformer or an inductor has a winding formed by a winding conductor, a solid insulation surrounding the winding and a connecting unit embedded in the solid insulation. The aim is to obtain a winding configuration which provides the required dielectric strength even at higher operating voltages. In order to achieve this goal, the connecting unit is a plug lead-through and is configured to allow the connection of a cable connector.

8 Claims, 2 Drawing Sheets

(51) Int. Cl.

| | |
|---|---|
| ***H01F 27/02*** | (2006.01) |
| ***H01F 41/10*** | (2006.01) |
| ***H01F 41/12*** | (2006.01) |
| ***H01F 27/30*** | (2006.01) |
| ***H01F 27/32*** | (2006.01) |

(58) Field of Classification Search
USPC ..... 174/152 R
See application file for complete search history.

(56) References Cited

U.S. PATENT DOCUMENTS

| | | | | |
|---|---|---|---|---|
| 7,834,736 | B1 * | 11/2010 | Johnson | H01F 27/022 336/229 |
| 2008/0290981 | A1 | 11/2008 | Bischoff et al. | |
| 2010/0218369 | A1 * | 9/2010 | Selbach | H01B 13/01209 29/700 |
| 2011/0057757 | A1 | 3/2011 | Skinner et al. | |
| 2012/0056702 | A1 | 3/2012 | Sebastian Balsalobre | |
| 2012/0071014 | A1 * | 3/2012 | Dais | H01B 17/28 439/181 |

FOREIGN PATENT DOCUMENTS

| | | | |
|---|---|---|---|
| CN | 201311830 | Y | 9/2009 |
| CN | 201975245 | U | 9/2011 |
| CN | 102568757 | A | 7/2012 |
| CN | 202749205 | U | 2/2013 |
| CN | 202771934 | U | 3/2013 |
| DE | 1613675 | A1 | 10/1970 |
| DE | 202011050949 | U1 | 1/2012 |
| DE | 202015103689 | U1 | 9/2015 |
| EP | 1876695 | A1 | 1/2008 |
| EP | 2490230 | A2 | 8/2012 |
| WO | 0108175 | A1 | 2/2001 |

* cited by examiner

WINDING ARRANGEMENT HAVING A PLUG-IN BUSHING

BACKGROUND OF THE INVENTION

Field of the Invention

The invention relates to a winding arrangement for a transformer or an inductor having a winding formed from a winding conductor, a solid insulation surrounding the winding and a connection unit embedded in the solid insulation.

The invention further relates to a method for producing a winding arrangement for a transformer or an inductor, in which method a winding formed from a winding conductor is embedded in a solid insulation.

A winding arrangement of this kind, which is also referred to as a dry winding, is known from established practice. For example, commercially available transformers have winding arrangements, which consist of a winding that is embedded in a solid insulation as a matrix. The previously known winding arrangements are of hollow-cylindrical design so that they can receive in the winding interior thereof a low-voltage winding and an iron core formed from laminations. If a voltage of up to 36 kV is therefore applied to a previously known winding arrangement of this kind, the magnetic field propagating in the core induces a voltage in the low-voltage winding. For the connection of a high voltage, the winding arrangement is generally fitted with a support, which can be used to screw a cable shoe of a high-voltage cable.

Furthermore, winding arrangements that have a plug-in bushing as connection unit are known, wherein the connection unit is built into a switching strip. However, a winding arrangement of this kind has the disadvantage that the configuration and embodiment of the connection unit limits the operating voltages. In other words, the previously known winding arrangement does not have the necessary dielectric strength in order to be used for operating voltages of more than 40 kV.

SUMMARY OF THE INVENTION

It is therefore the object of the invention to provide a winding arrangement of the type mentioned at the beginning, which winding arrangement provides the required dielectric strength even at relatively high operating voltages.

The invention achieves this object by virtue of the fact that the connection unit is a plug-in bushing and is configured for connection of a cable plug.

Within the context of the invention, the connection unit has been designed as a plug-in bushing, wherein, in contrast to the prior art, the plug-in bushing is embedded in the solid insulation of the winding. A plug-in bushing of this kind differs from the supports that until now have been embedded in the solid insulation by virtue of the fact that a commercially available cable plug can be connected in a simple manner to the plug-in bushing. The connection of the winding arrangement to a high voltage is therefore simplified within the context of the invention.

Plug-in bushings are as such already known and commercially available. For example, previously known plug-in connections are used, in particular, when the operating voltages for the winding arrangement are above 40 kV. In connection with transformers, plug-in bushings are used substantially in the case of oil transformers. According to the invention, a commercially available plug-in bushing is adapted in order to subsequently be able to be embedded in the solid insulation of the winding.

The plug-in bushing advantageously has a standardized cable connection socket. According to this advantageous development, it is possible to make contact with the winding arrangement with the aid of commercially available standardized cable plugs. Furthermore, the plug-in bushing is dimensioned depending on a respectively required operating voltage. In particular, the plug-in bushing has a dielectric strength necessary for this. In other words, the plug-in bushing is dimensioned depending on the respectively required operating voltage.

According to a further variant of the invention, each plug-in bushing has a phase conductor, which extends through a bushing insulation consisting of a solid body, wherein field control elements are embedded in the bushing insulation. With the aid of the field control elements, it is possible to prevent high electrical field strengths, which can arise during operation between the phase conductor of the plug-in bushing and the outer surface of the solid insulation, which is usually at ground potential.

The plug-in bushing expediently has a flange section formed from a solid insulation and is connected to a receptacle section of the solid insulation by means of the flange section, which receptacle section protrudes from the solid insulation on an outer surface thereof. According to this advantageous development, the solid insulation has a receptacle section, which is designed with a shape complementary to the side of the plug-in bushing that faces the solid insulation. A design of this kind is achieved, for example, by virtue of the plug-in bushing being connected to a molded part before casting. The molded part is removed after curing of the insulation material.

The winding arrangement has a generally hollow-cylindrical winding interior, which serves for receiving a low-voltage winding and/or a limb of an iron core. The circumferentially closed winding extends in this case completely within the solid insulation, the outer envelope of which is therefore likewise of substantially cylindrical design. The receptacle section projects out of the cylindrical outer contour substantially at a right angle. An electrical connecting conductor that extends through the receptacle section connects a connection of the embedded winding to a phase conductor of the plug-in bushing. All of the electrical conductors are embedded in a solid insulation material in this way so that the required dielectric strength is produced.

The receptacle section is expediently of cylindrical design. A cylindrical design provides an even symmetrical insulation on all sides.

According to a preferred refinement of the invention, the plug-in bushing has a connection side and a winding side that faces the solid insulation, which winding side faces away from the connection side. In this case, the winding side is provided with recesses. The recesses increase the surface of the plug-in bushing on the side at which the plug-in bushing is connected to the solid insulation. Each recess increases the surface of the plug-in bushing so that a more secure hold of the plug-in bushing on the solid insulation is provided during curing of the solid insulation on account of the materially bonded connection that is produced. As the recess, it is possible to consider, for example, a circumferentially closed encircling channel structure with a rectangular cross section. However, particular advantages result when the recesses have closed, encircling, rounded-off groove structures. A groove structure of this kind makes it possible for the solid insulation to engage behind the plug-in bushing in the region of the recesses so that, in addition to a materially bonded connection, a form-fitting connection is also made possible between the cured solid insulation and the insulation of the plug-in bushing.

Proceeding from the method mentioned at the beginning, the invention achieves the object by virtue of the fact that the solid insulation is integrally formed on a plug-in bushing for connection of a cable plug. According to the invention, a commercially available plug-in bushing can therefore be integrally formed on the solid insulation of the winding arrangement. A specific design of the plug-in bushing has therefore become superfluous. Complex in-house developments and adjustments to the plug-in bushing as such are prevented.

According to a development that is expedient in this regard, the plug-in bushing is provided with recesses at the winding side of said plug-in bushing that faces the solid insulation before the embedding in the solid insulation. As has already been stated further above, the recesses serve to increase the surface so that the solid insulation is in contact with the plug-in bushing over a larger surface area. This produces a secure hold.

Further advantages are produced when circumferentially closed grooves or channels are milled into the winding side. In this case, channels have a rectangular structure whereas grooves are of arcuate design in cross section.

BRIEF DESCRIPTION OF THE SEVERAL VIEWS OF THE DRAWING

Further expedient refinements and advantages of the invention are the subject matter of the following description of exemplary embodiments of the invention with reference to the figures of the drawing, wherein identical reference signs refer to identically functioning components and wherein.

DESCRIPTION OF THE INVENTION

Figure 1:
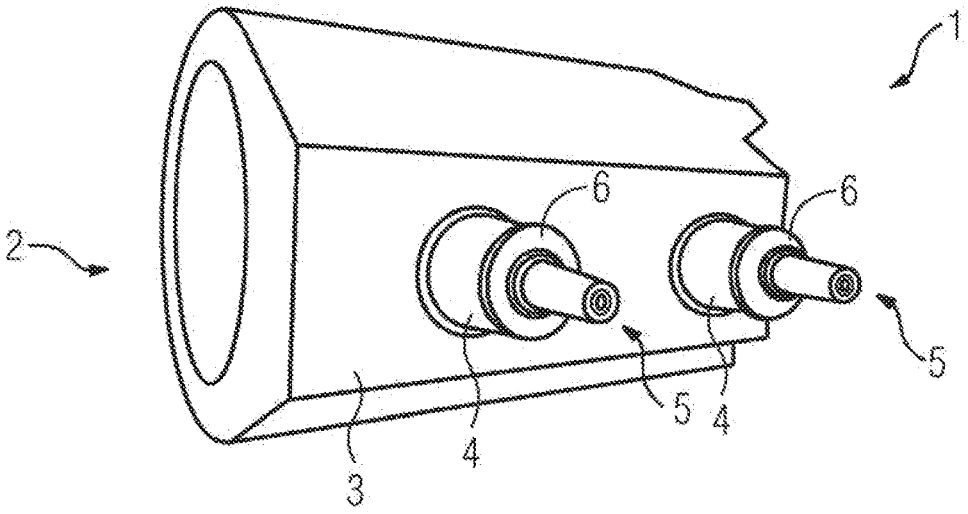
FIG. 1 shows a perspective view of an exemplary embodiment of the winding arrangement according to the invention.

FIG. 1 shows a perspective illustration of an exemplary embodiment of the winding arrangement 1 according to the invention. It can be seen that the winding arrangement 1 has a cylindrical interior 2 for receiving a low-voltage winding and a limb of an iron core of a transformer. The outer casing, or in other words the outer contour, is of substantially cylindrical design, wherein the winding arrangement 1 has a connection side 3, which is flattened in comparison to the cylindrical outer casing. Two receptacle sections 4 project on the connection side 3, which receptacle sections are embodied in a cylindrical manner in the exemplary embodiment shown. The receptacle sections 4 extend at a right angle to a central axis of the cylindrical interior 2 and each serve for receiving a plug-in bushing 5, wherein each plug-in bushing 5 sits on the respective receptacle section 4 by way of a disk-shaped flange section.

Figure 2:
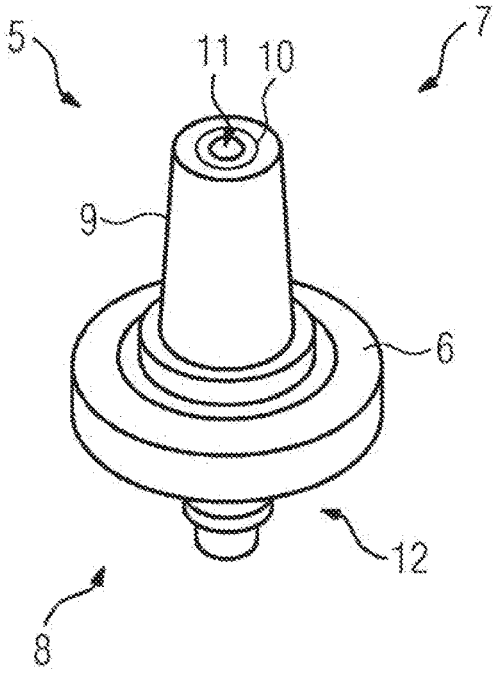
FIGS. 2 and 3 show a plug-in bushing of the winding arrangement according to FIG. 1
Figure 3:
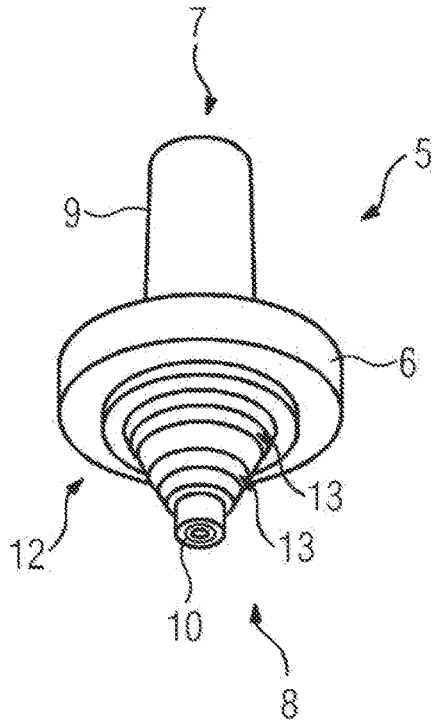

FIGS. 2 and 3 show the plug-in bushing 5 in more detail. It can be seen that the plug-in bushings 5 have a cable side 7 and a winding side 8. In this case, the cable side 7 and the winding side 8 are separated from one another by the disk-shaped flange section 6. A column section 9 projects from the disk-shaped flange section 6, which column section is designed in a conical manner or in other words with a frustoconical shape. In this case, the column section 9 surrounds a conductor 10, a threaded connection 11 in the form of an internal thread being formed at the free end of said conductor that faces away from the flange section 6. The column section 9 is embodied with a shape complementary to a standardized cable plug (not illustrated in the figures). The entire bushing is therefore likewise standardized, wherein the standard corresponds, for example, to EN 50181. The standard stipulates, for example, the size of the internal thread, for example M16, and the dimensioning and the type of frustoconical column section. The internal thread 11 serves to fix the cable conductor, which extends within a plug head. The plug head is placed over the column section.

The conductor 10 of the plug-in bushing 5 extends from the cable side 7 centrally through the column section 9 and contact can be made therewith on the winding side 8 by a winding arranged in the solid insulation of the winding arrangement 1. In this case, on the winding side, the conductor 10 projects through a stepped section 12 of the plug-in bushing 5, which stepped section can be seen particularly well in FIG. 3. The stepped section 12 thus has circumferentially closed encircling grooves 13 as recesses, which are used to increase the surface of the plug-in bushing 5 at the winding side 8. An improved materially bonded connection between the plug-in bushing 5 and the solid insulation of the winding arrangement 1 is made possible on account of the increased outer surface of the plug-in bushing 5. Finally, it should be mentioned that the conductor 10 consists of an electrically conductive material, which is completely embedded in a bushing insulation consisting of an insulation material.

The column section 9, the flange section 6 and the winding section 12 therefore consist of a solid bushing insulation material. Field control elements (not illustrated in the figures) are also embedded in the bushing insulation.

Figure 4:
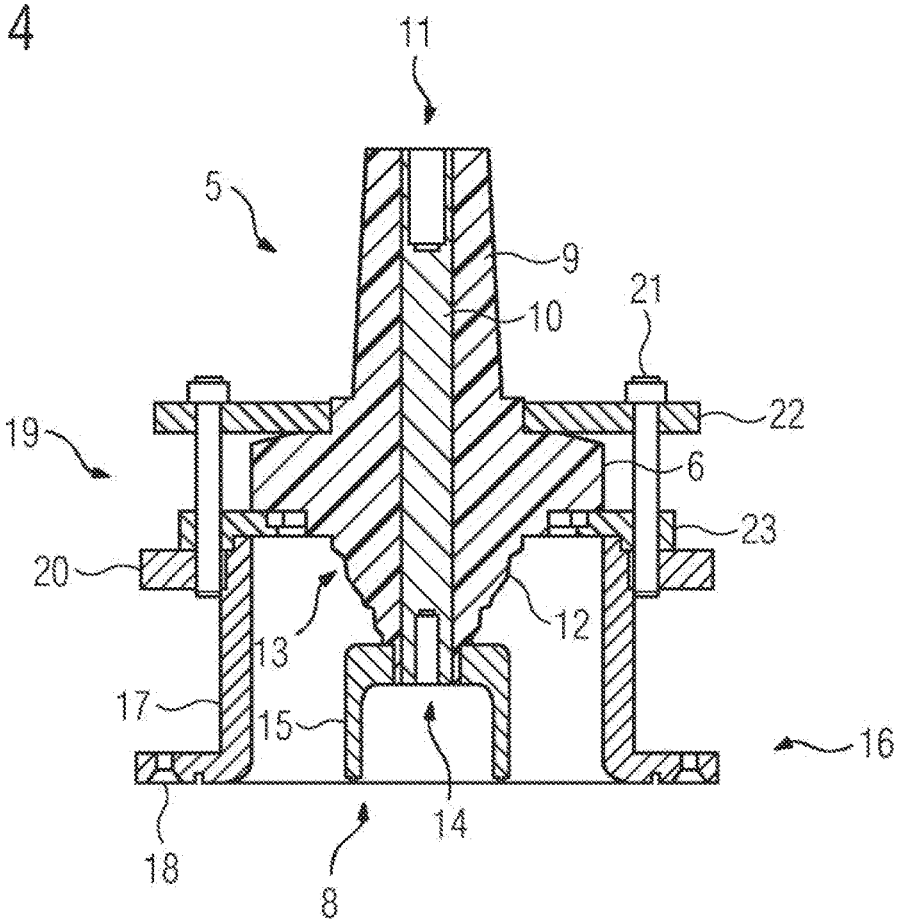
FIG. 4 shows a cut-away side view of the plug-in bushing of the bushing according to FIG. 1.

FIG. 4 illustrates a preferred exemplary embodiment of the method according to the invention, in which the bushing 5 is integrally formed on the solid insulation of the winding arrangement 1. In the cut-away side view shown, it can be seen that the conductor 10 extends from the cable connection socket 11 through the entire bushing insulation, which consists of an electrically non-conductive material, for example an expedient resin. In this case, the threaded connection 11 is embodied as a cylindrical blind opening.

On the winding side 8, a winding connection 14 in the form of a threaded opening is incorporated into the conductor 10. To prevent high field strengths on the winding conductor 8, a metallic shield arrangement or shield element 15 is mounted. The shield element 15 is electrically conductively connected to the conductor 10.

FIG. 4 furthermore shows a mold 16, which consists of a receptacle section mold 17, which is fixedly connected to the remaining components of the mold 16 by means of connecting means 18. The receptacle section mold 17 is provided on its side that faces away from the fastening means 18 with holding means 19, which comprise a clamping ring 20, which is configured to fixedly clamp the holding means 19 on the receptacle section mold 17. In this case, the clamping ring 20 surrounds the receptacle section mold 17 in a circumferential manner. The clamping ring 20 has a passage opening with an internal thread, which opening engages in each case with a clamping screw 21. The clamping screws 21 extend through clamping brackets 22 and through an abutment 23, wherein the abutment 23 sits on the upper edge of the receptacle section mold 17. The flange section 6 of the plug-in bushing 5 extends between the clamping brackets 22 and the abutment 23 so that the plug-in bushing 5 is fixedly held on the receptacle section mold 17 by rotation of the clamping screws 21. The grooves 13 shown in FIG. 3 have been incorporated into the winding side before the clamping.

After the plug-in bushing 5 is connected to the mold 16 for the solid insulation, as shown in FIG. 4, the winding (not illustrated in the figures) is molded, wherein the liquid insulation material, for example a liquid resin, is cast into the mold 16. The solid insulation is subsequently cured and the clamping means 19 and the mold 16 are removed so that the winding arrangement 1 illustrated is FIG. 1 is provided.

The invention claimed is:

1. A winding configuration for a transformer or an inductor, the winding configuration comprising: a winding formed from a winding conductor; a solid insulation surrounding said winding; and a connection unit embedded in said solid insulation, said connection unit is a plug-in bushing and is configured for connection to a cable plug; said plug-in bushing having a cable connection socket formed therein; said solid insulation having an outer surface with a receptacle section protruding from said outer surface; said plug-in bushing having a flange section formed from a solid bushing insulation; and said plug-in bushing connected to said receptacle section by said flange section.

2. The winding configuration according to claim 1, wherein said plug-in bushing is standardized.

3. The winding configuration according to claim 1, wherein said plug-in bushing has field control elements, a bushing insulation formed of a solid body and a conductor, said conductor extends through said bushing insulation, said field control elements are embedded in said bushing insulation.

4. The winding configuration according to claim 1, wherein said receptacle section has a cylindrical design.

5. The winding configuration according to claim 1, wherein said plug-in bushing has a connection side and a winding side that faces said solid insulation, wherein said winding side has recesses formed therein.

6. A method for producing a winding configuration for a transformer or an inductor, which comprises the steps of:

providing the winding configuration according to claim 1;

embedding the winding formed from the winding conductor in the solid insulation; and integrally forming the solid insulation on the plug-in bushing configured for connecting to a cable plug.

7. The method according to claim 6, which further comprises providing the plug-in bushing with recesses on a winding side of the plug-in bushing that faces the solid insulation before being embedded in the solid insulation.

8. The method according to claim 7, which further comprises milling circumferentially closed grooves or channels into the winding side as the recesses.

* * * * *